United States Patent [19]

Schröder et al.

[11] 4,337,847

[45] Jul. 6, 1982

[54] DRIVE CONTROL FOR AN ELEVATOR

[75] Inventors: Joris Schröder, Lucerne; Martin Meier, Gisikon, both of Switzerland

[73] Assignee: Inventio AG, Hergiswil, Switzerland

[21] Appl. No.: 184,121

[22] Filed: Sep. 4, 1980

[30] Foreign Application Priority Data

Sep. 27, 1979 [CH] Switzerland ..... 8687/79

[51] Int. Cl.[3] ..... B66B 1/30

[52] U.S. Cl. ..... 187/29 R

[58] Field of Search ..... 187/29

[56] References Cited

U.S. PATENT DOCUMENTS

| | | | |
|---|---|---|---|
| 3,774,729 | 11/1973 | Winkler | 187/29 |
| 3,941,214 | 3/1976 | Young et al. | 187/29 |
| 4,124,101 | 11/1979 | Satoh | 187/29 |
| 4,128,142 | 12/1978 | Satoh et al. | 187/29 |
| 4,130,184 | 12/1978 | Satoh et al. | 187/29 |
| 4,155,426 | 5/1979 | Booker, Jr. | 187/29 |

*Primary Examiner*—J. V. Truhe
*Assistant Examiner*—W. E. Duncanson, Jr.
*Attorney, Agent, or Firm*—Werner W. Kleeman

[57] ABSTRACT

A drive control for transportation systems, especially elevators or the like, improves the stopping accuracy of the elevator cabin at a storey or floor of the building. A reference value transmitter operated by a digital computer produces step-like successive travel curves and displacement path-reference values operatively associated with such travel curves and feedable to a regulation circuit. Connected with the reference value transmitter is a stop initiation device, which during initiating the stop or halting of the elevator, forms from a possible target path produced by the reference value transmitter and a target path corresponding to a target storey a target error. This target error is infed to a stop correction device connected with the reference value transmitter and the stop initiation device, which while utilizing the target error modifies by interpolation the travel curve which is to be produced by the reference value transmitter in a manner such that there is available for regulation an optimum travel curve to the target storey. An arrival correction device which further improves the halt or stop accuracy of the elevator, forms from the elevator cabin site determined at a cabin displacement path counter and the storey site of the target storey a difference which, for the purpose of further correction of the displacement path-reference value, is infed to the stop correction device. This drive control, apart from being used with elevator systems, for instance also can be employed for track-bound horizontal systems.

11 Claims, 4 Drawing Figures

Reference Value Cycles

DRIVE CONTROL FOR AN ELEVATOR

BACKGROUND OF THE INVENTION

The present invention relates to a new and improved construction of a drive control for an elevator or the like.

Generally speaking, the drive control of the present development for an elevator or other transport systems comprises a regulation circuit composed of a velocity regulation circuit, a position regulation circuit, at least one pulse transmitter operatively associated with an actual value transmitter of the position regulation circuit, and at least one digital-analogue converter (D/A-converter). Additionally, there is provided a reference value transmitter which generates a group of travel curves. The reference value transmitter possesses a control storage which contains at least permissible jolt or jerk values and threshold values of the acceleration and which is connected with three summation stages which generate the acceleration, the velocity and the path by continuous numerical integration. The output magnitudes of the last summation stage are infeed to the regulation circuit as displacement path-reference value, and for the determination of the braking application point there is provided a stop initiation device which produces a stop initiation signal and coacts with the control storage and a storey site storage.

In German Pat. No. 1,302,194 there has been disclosed such type of drive control. Here, the determination of the braking initiation point, and thus, the possible halt or stop point, is accomplished by continuous computations during the acceleration phase while utilizing a digital computer. The computation is predicated upon considering the geometric conditions of the momentary velocity travel curve. The area below the travel curve, corresponding to the reference value, is converted in the velocity-time diagram into a trapezoidal area or surface whose first boundary line coincides with the velocity axis and whose second boundary line extends parallel thereto. The intersection point of the second line with the travel curve constitutes the brake application or initiation point. The length of the first boundary line corresponds to an initial velocity $v_{ho}$, whereas the slope of a third, upper boundary line corresponds to an acceleration $b_h$. From these values stored in a control device, there is formed in a first integrator the velocity and in a subsequently connected second integrator a possible stop or halt path $s_{halt}$. In a comparison device this path is compared with a target path $s_{targ}$ set at a target position transmitter and corresponding to a storey for which there has been stored a call. When $s_{halt}=s_{targ}$ the comparison device or comparator generates a signal, causing the control device to initiate the deceleration by delivering threshold values for jerk and deceleration movements to three further, series connected integrators. The reference value $s_{ref}$ generated in the third integrator is infed to a position regulation circuit. A counter, which counts the pulses of a pulse transmitter driven by the drive machine, forms the actual path $s_{act}$, which likewise is infed to the position regulation circuit.

With this drive control it is possible that due to the stepwise generation of the travel curves the halt path $s_{halt}$ and the reference path $s_{ref}$, respectively, do not correspond with the target path $s_{targ}$, so that there result stop or halt inaccuracies. Furthermore, the deviations, resulting from cable slip and elongation, between the actual elevator cabin path and the actual path determined by the pulse transmitter and counter, cannot be detected, so that also in this case, depending upon the displacement path length and weight, there can arise rather extensive halt inaccuracies. The technique of continuous computation of the possible halt path, employed with this drive control for the purpose of determining the brake initiation or application point, requires appreciable computations, and thus, corresponding computer capacity, something which is unfavorable from the standpoint of the economy of the system. The use of a second D/A-converter, needed because of the incorporation of the velocity-reference value in analogue form into the velocity regulation circuit, results in additional costs.

SUMMARY OF THE INVENTION

Therefore, with the foregoing in mind it is a primary object of the present invention to provide a new and improved construction of drive control for an elevator which is not associated with the aforementioned drawbacks and limitations of the prior art.

Another and more specific object of the present invention aims at providing a drive control for elevators or other transportation systems, which is an improvement in relation to the heretofore described drive control, and wherein particularly with drive controls working with digital computers there can be generated an optimum reference travel curve, there can be realized a more exact determination of the elevator cabin displacement path, the computation work can be reduced to a minimum, and there is an additional stabilization of the regulation circuit.

The advantages realized with the invention essentially reside in the fact that the optimum reference travel curve produced by the proposed travel curve-interpolation, results in greater halting or stop accuracy with minimum time deviations, without impairment of the travel comfort, and there is possible the use of a cost-favorable reference value transmitter possessing a relatively coarse resolution capability. Additionally, more exact determination of the halting errors and their compensation by the proposed correction devices contributes to improvement of the halting or stop accuracy of the elevator. An additional advantage resides in the fact that the pulse transmitter of the position regulation circuit-actual value transmitter is directly driven by the velocity limiter, since in this way there can be formed the exact cabin location independent of the elongation of the support cable by loads or oscillations. Additionally, economical advantages are realized through the use of only one D/A-converter.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
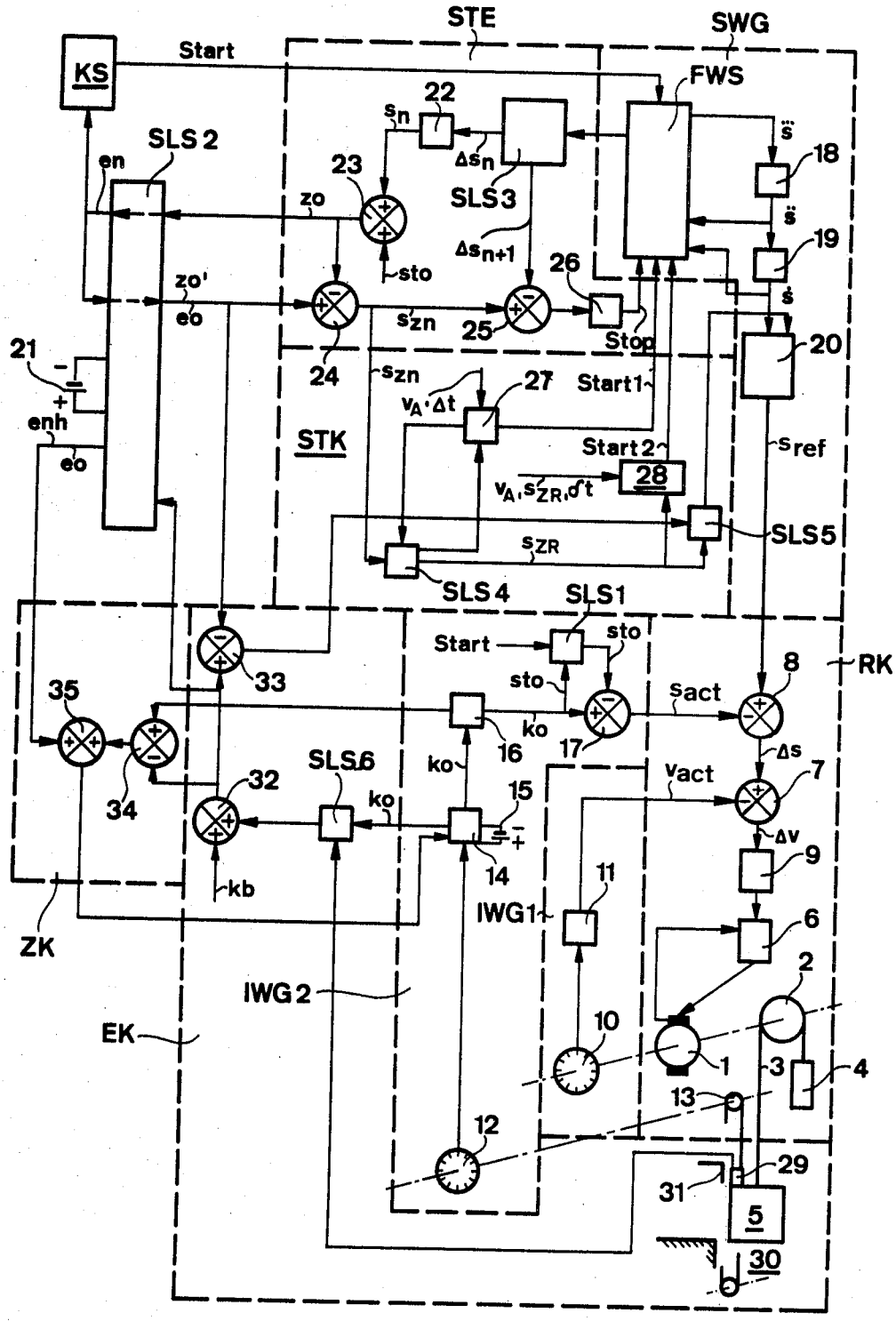
FIG. 1 is a block circuit diagram of an exemplary embodiment of inventive drive control.

Describing now the drawings, in FIG. 1 reference character RK designates a regulation circuit whose regulation path or loop comprises a drive machine or drive unit 1 which drives, by means of a drive pulley or disc 2, an elevator cabin 5 suspended at a conveying cable or rope 3 and balanced by means of a counter weight 4. The regulation circuit RK, functioning according to the principle of cascade regulation consists of a current regulation circuit containing a regulator 6. As will be explained more fully hereinafter, the current regulation circuit 6 has superimposed a velocity regulation circuit possessing a first subtracting unit 7 for the formation of a regulation deviation $\Delta v$, which has superimposed a position regulation circuit containing a second subtracting unit or device 8 for the formation of a regulation deviation $\Delta s$. At the output of the first subtracting unit 7 there is arranged a digital-analogue converter 9.

A first actual-value transmitter IWG1 operatively associated with the velocity regulation circuit 7 possesses a pulse transmitter 10 coupled with the shaft of the drive machine or drive unit 1. The pulse transmitter 10 may be constituted by a conventional digital tachometer. The pulses produced by the pulse transmitter 10 are delivered to a counter 11 whose output is connected with the first subtracting unit or device 7.

A second actual-value transmitter IWG2 associated with the position regulation circuit possesses a pulse transmitter 12 similar to the pulse transmitter 10 of the first actual-value transmitter IWG1, this pulse transmitter 12 producing, for instance, one pulse for each 0.5 mm travel path. This pulse transmitter 12 is driven by the elevator cabin 5, preferably by means of a velocity limiter 13 and is connected with a cabin displacement path counter 14. The cabin displacement path counter 14 possesses a voltage source 15 which is independent of the power supply network, this voltage source 15 ensuring that the determined cabin displacement path is maintained even in the event of power failure. The cabin displacement path counter 14 is connected by means of a copier or copy unit 16 with a further subtractor or subtracting device 17, the inputs of which are connected with a start site storage SLS1 and whose output is connected with the subtracting device 8 of the position regulation circuit.

The start site storage or memory SLS1 in the form of a random access memory (RAM) as well as the copier 16 in the form of a data buffer are connected by means of a data bus with a conventional microprocessor of a microcomputer system. The functions of the subtracting devices 7, 8 and 17 are carried out by the computer section of the microprocessor.

Figure 2:
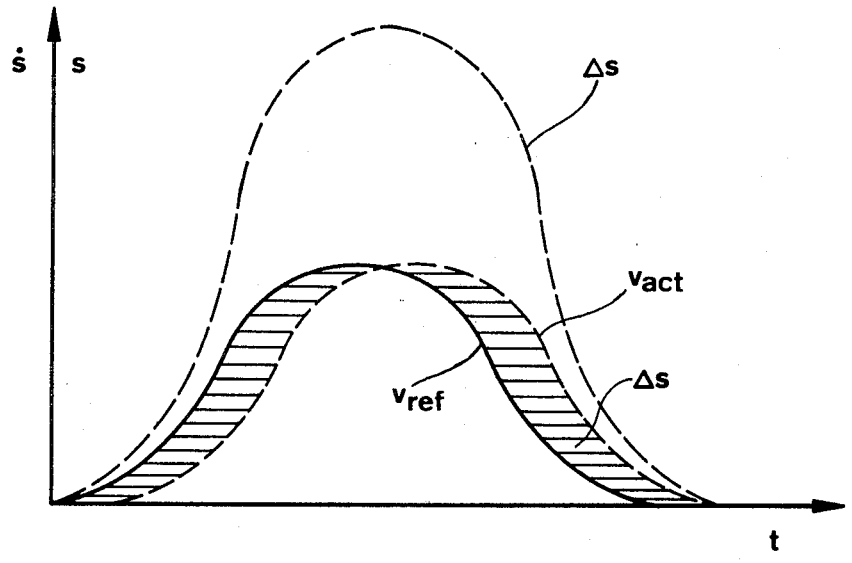
FIG. 2 is a diagram illustrating the reference and actual velocities and the resultant displacement path error $\Delta s$.

The previously described regulation circuit RK functions in the following manner:

During the descent of the elevator cabin 5 from a storey there is written into the start site storage or memory SLS1 as the start site sto the state of the cabin displacement path counter 14 corresponding to the momentary cabin site or location ko. The cabin site ko and the start site sto are level numbers, represented in binary form, with respect to a predetermined base, for instance the floor of the elevator cabin, when the elevator cabin 5 is at its lowest stop. During travel the pulses produced by the digital tachometer 12 of the second actual-value transmitter IWG2 are added at the cabin displacement path counter 14 and the thus determined momentary cabin location or site ko is imputted by means of the copier 16 to the subtracting device 17, and the data recall from the cabin displacement path counter 14 into the copier device 16 is controlled by the clock generator of the microprocessor by means of a pulse stepdown device. In the subtracting device 17 the start site sto which is recalled from the start site memory or storage SLS1 is subtracted from the momentary cabin site or location ko. The thus determined cabin path is infed as an actual value $s_{act}$ to the second subtracting device 8, whose further input magnitude is constituted by the path $s_{ref}$ produced in a reference value transmitter SWG which will be described more fully hereinafter. The output magnitude of the second subtracting device 8, the displacement path error $\Delta s$, which almost possesses the form of the velocity-reference value $v_{ref}$ (FIG. 2) is infed to the first subtracting device 7. In the counter 11 there are added the pulses produced by the digital tachometer 10 of the first actual-value transmitter IWG1 and while taking into account the time there is formed the velocity-actual value $v_{act}$, which is then infed to the first subtracting device 7. The output magnitude of this subtracting device, the velocity error $\Delta v$, is infed by means of the digital-analogue converter 9 to the input of the regulator 6, whose further input magnitude is constitued by the armature current $I_A$ of the drive machine or drive motor 1. The output magnitude of the regulator 6 acts in conventional manner upon the drive machine 1.

The reference value transmitter SWG consists of a control storage or memory FWS and of three summation stages 18, 19 and 20 which produce the acceleration s, the velocity $\dddot{s}$ and the displacement path $\dot{s}$, wherein the summation stages 18 and 19 generating the acceleration and the velocity each have a feedback to the control storage FWS. The control storage FWS comprises a programmable read-only memory (PROM), with which there is operatively associated a reference value-clock generator which is controlled by the clock generator of the microprocessor by means of a pulse stepdown device and which is connected by means of the data bus with the microprocessor. In the control storage FWS there are stored the permissible jerk or jolt values $\dddot{s}$ as well as the threshold values of the acceleration $\ddot{s}_{lim}$ and velocity $\dot{s}_{lim}$ which can be altered by a suitable adjustment device. The functions of the summation stages 18, 19 and 20 are performed by the computer section of the microprocessor.

The previously described reference value transmitter SWG functions in the following manner:

During a start command there are infed to the reference value-clock generator of the control storage or memory FWS clock signals from the clock generator of the microprocessor by means of the pulse stepdown device, so that the reference value-clock generator begins to operate. During one cycle of the clock signal, hereinafter referred to as the reference value clock, the related jolt or jerk value $\dddot{s}$ is recalled out of the control storage FWS and infed to the first summation stage 18. By means of progressive numerical integration there takes place in each case in the summation stage 18 the determination of the acceleration $\ddot{s}$, in the following summation stage 19 the determination of the velocity value $\dot{s}$ and in the last summation stage 20 the determination of the displacement path value s in the form of a binary number, which is infed to the second subtracting unit or device 8 of the regulation circuit RK. Upon reaching the threshold values $\ddot{s}_{lim}$ or $\dot{s}_{lim}$ there is recalled the new corresponding jerk value $\dddot{s}$ and delivered to the first summation stage 18. The velocity-travel curves which can be produced by means of the reference value transmitter FWG extend in each case throughout an even number of reference value cycles (FIG. 3), and thus, at the target region possess a spacing which encompasses two reference value cycles, i.e. they are produced in a step-shaped sequence. Each individually possible travel curve has operatively associated therewith a velocity-threshold value $\dot{s}_{lim}$, at which time there must be initiated the halt or stop operation, so that the corresponding travel curve can be ascertained for the fundamental basis of the regulation.

Figure 3:
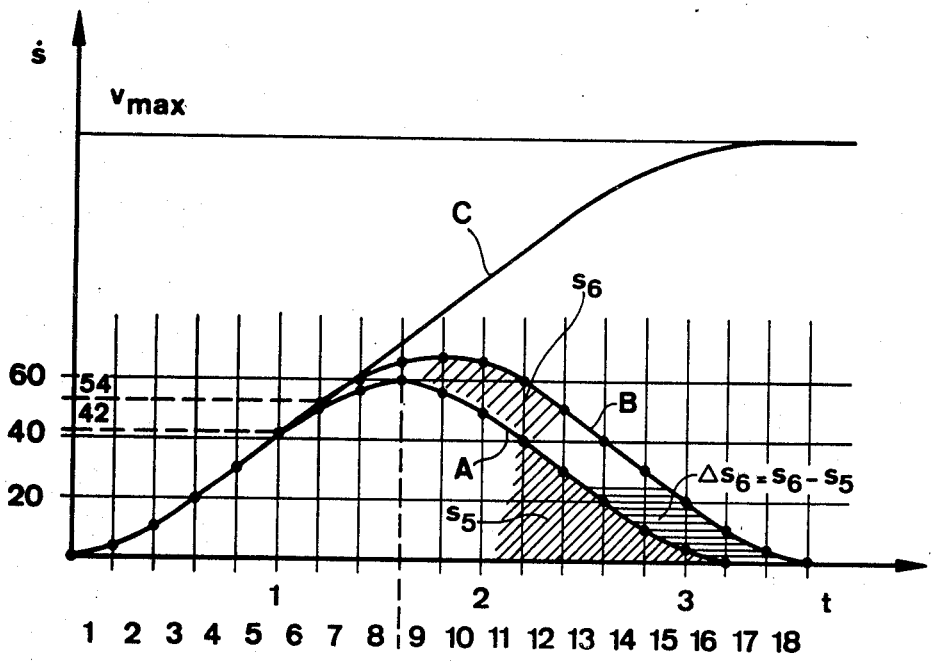
FIG. 3 is a diagram illustrating a number of velocity travel curves producable by a reference value transmitter.

Thus, for instance, as shown in FIG. 3 and explained below in the following Table, during the reference value cycles or steps 1, 2 and 3 there are recalled the jerk or shift values $\dddot{s}=+4$ and after reaching the acceleration threshold value $\ddot{s}_{lim}=12$ there is recalled the jerk value $\dddot{s}=0$ Upon arrival of a stop command during the reference value cycle s and attainment of the velocity-threshold value $\dot{s}_{lim}=42$ of travel curve A encompassing 16 reference value cycles there are recalled the jerk values $\dddot{s}=-4$. If the stop command only appears during the reference value cycle 6, then upon reaching the velocity-threshold value $\dot{s}_{lim}=54$ of the next following travel curve B encompassing 18 reference value cycles, there is recalled the new jerk value $\dddot{s}=-4$.

| | Travel Curve | Reference Value Cycles 1 | 2 | 3 | 4 | 5 | 6 | 7 | 8 | 9 | 10 |
|---|---|---|---|---|---|---|---|---|---|---|---|
| Jerk $\dddot{s}$ | A | +4 | +4 | +4 | 0 | 0 | −4 | −4 | −4 | −4 | −4 |
| | B | +4 | +4 | +4 | 0 | 0 | 0 | −4 | −4 | −4 | −4 |
| Accel. $\ddot{s}$ | A | 4 | 8 | 12 | 12 | 12 | 8 | 4 | 0 | −4 | −4 |
| | B | 4 | 8 | 12 | 12 | 12 | 12 | 8 | 4 | 0 | −4 |
| Vel. $\dot{s}$ | A | 2 | 8 | 18 | 30 | 42 | 52 | 58 | 60 | 58 | 52 |
| | B | 2 | 8 | 18 | 30 | 42 | 54 | 64 | 70 | 72 | 70 |
| Path s | A | 1 | 6 | 19 | 43 | 79 | 126 | 181 | 240 | 299 | 354 |
| | B | 1 | 6 | 19 | 43 | 79 | 127 | 186 | 253 | 324 | 395 |

The numerical values listed in the preceding table for jerk, acceleration, velocity and path are condition or relationship numbers which have been stored in the form of binary numbers, and they therefore do not correspond to the actual values of the related physical magnitudes.

A command control KS which gives start and stop commands, is connected with the reference value transmitter SWG and a storey site storage or memory SLS2. The storey site memory SLS2 comprises a buffered, alterable storage or memory in the form of a random access memory, which is provided with a voltage source 21 which is independent of the power supply network and a logic for incrementizing and deincrementizing the storey numbers, and which is connected by means of the data bus or bus bar with the microprocessor. At the storey site memory SLS2 there are stored in the form of binary numbers the storey locations or sites eo correlated to the storey or floor numbers, and which likewise relate to the previously defined base. The writing-in of the storey sites or locations eo is accomplished during an automatically initiated trial travel before first placing into operation the elevator, and also in the event of possible data loss of the storey site memory SLS2.

A stop initiation device STE connected with the reference value transmitter SWG and the storey site storage or memory SLS2 consists of a target path stepping storage SLS3, a target path stepping summing device 22, an adder 23, a first and a second subtracting device 24 and 25 and a comparator 26. The target path stepping storage SLS3 is constituted by a random access memory connected with the microprocessor by means of the data bus. The functions of the target path stepping summing device 22, the adder 23, the subtracting devices or units 24 and 25 and the comparator 26 are performed by the computer section of the microprocessor. The target path steps $\Delta s_n=s_n=s_{n-1}$ stored in the target path stepping storage SLS3 constitute the difference between two neighboring target paths (FIG. 3) correlated to the momentary velocity-travel curves.

Figure 4:
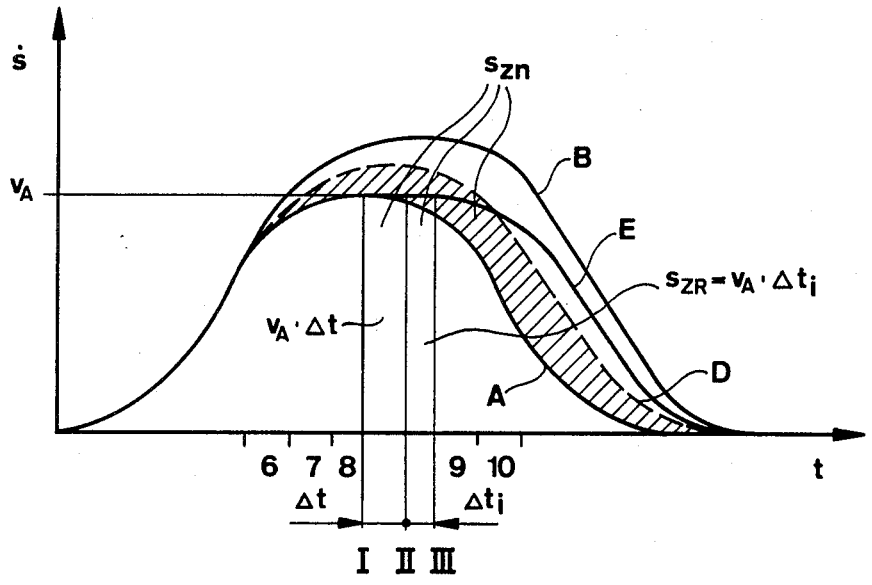
FIG. 4 is a diagram of an ideal travel curve which deviates from a reference travel curve, the thus resultant target error $s_{zn}$ and an optimum travel curve which can be produced by interpolation.

The previously described halt or stop initiation device STE functions in the following manner:

After infeed of a start command there is recalled during each reference value cycle n the related target path step $\Delta s_n$ from the target path stepping storage SLS3 and infed to the target path stepping summing device 22, whereby there is formed at the latter by accumulation the target path $s_n$. Thus, for instance, by adding the target path step $\Delta s_6$, correlated to the reference value cycle 6, to the target path $s_5$ there is produced the target path $s_6$ (FIG. 3). During a reference value cycle n there is initially added in the adder 23 to the target path $s_n$ the start site or location sto which is recalled from the start site storage or memory SLS1 and in this way there is computed the possible target site zo. At the storey site storage SLS2 there is determined by incrementizing during the up-travel or deincrementizing during the down-travel the storey site or location which is situated closest to the possible target site zo. The corresponding storey or floor number en is infed to the command control KS, where there occurs a comparison with the stored calls. If there is present for this storey or floor a call, then the corresponding storey site or location eo is recalled as the target storey site zo' from the storey site memory or storage SLS2 and is infed to the subtracting device or unit 24. In the subtracting device 24 there is subtracted from the target storey site zo' the possible target site or location which has been formed in the adder or adding unit 23 and thus there is formed the target error $s_{zn}=s_x-s_n$, wherein $s_x$ constitutes the difference between the target storey site zo' and the start site sto and which corresponds to a path correlated to an ideal travel curve D (FIG. 4). The target error $s_{zn}$ is infed to the subtracting device 25, where while adding the target path step $\Delta s_{n+1}$ of the next reference value cycle n+1 there is determined the difference $s_{zn}-\Delta s_{n+1}$. If the subsequent evaluation in the comparator 26 gives the result $s_{zn}\Delta s_{n+1}\leqq 0$, then there is initiated the stop or halt by delivering a stop signal to the control storage or memory FWS. If the previously described operations occur for instance during the reference value cycle 6 then based upon the stop or halt signal, after reaching the velocity threshold value $\dot{s}_{lim}=54$ correlated to such reference value cycle, there is recalled during the next following reference value cycle 7 the new jerk value $\dddot{s}=-4$ and there is produced, as will be recognized from the preceding table and FIG. 3, the travel curve B serving for the further regulation.

The previously described operations repeat during each reference value cycle. If, however, the possible target site zo and the target storey site zo' are so far apart that the difference is $s_{zn}-\Delta s_{n+1}>0$, then the comparator 26 does not deliver any stop or halt signal and the reference value transmitter SWG can for instance produce the travel curve C (FIG. 3) which ascends to the rated velocity $v_{max}$ of the elevator.

A stop or halt correction device STK connected both with the reference value transmitter SWG and also with the stop initiation device STE, has assigned thereto the task of modifying by interpolation the travel curve which is to be produced by the reference value transmitter SWG in such a manner that there is available an optimum travel curve to the target storey or floor for the regulation. The stop or halt correction device STK comprises a target fault memory or storage SLS4, a residual error storage SLS5, a target error comparator 27 and a correction time determination device 28. The storages or memories SLS4 and SLS5 are random access memories (RAM's) which are connected by means of the data busbar with the microprocessor, and the functions of the target fault or error comparator 27 and the correction time determining device 28 are carried out in the computer section of the microprocessor.

The previously described stop correction device STK functions in the following manner:

It is assumed that during the halt or stop initiation the travel curve A has been selected (FIGS. 3 and 4). Upon reaching the peak velocity $v_A=s=60$ of the reference value cycle 8 governed by the acceleration $s=0$, the target error $s_{zn}$ resulting from the difference of the path $s_n$ of the travel curve A and the path $s_x$ of the ideal travel curve D is converted into an equal area rectangle. This occurs in a manner such that the reference value transmitter SWG is iniatially placed out of operation (see the Table and point I of FIG. 4). Then during the duration $\Delta t$ of a reference value cycle there is formed a path value $v_A\cdot\Delta t$ (rectangle $v_A\cdot\Delta t$, FIG. 4) and compared in the target error comparator 27 with the target error $s_{zn}$ stored in the target error storage SLS4. With $s_{zn}\geqq v_A\cdot\Delta t$ there is produced in the target error comparator 27 a first start signal, by means of which there is again recalled the peak velocity $v_A=60$ from the control storage FWS which is correlated with the reference value cycle (see point II FIG. 4). At the same time there is reduced by the path value $v_A\cdot\Delta t$ the target error or fault $s_{zn}$ stored in the target error storage SLS4. During a renewed comparison in the target error comparator 27 it is assumed that the remaining or residual target error $s_{ZR}$ which remains in the target error storage SLS4 is smaller than the path value $v_A\cdot\Delta t$. In this case the residual target error $s_{ZR}$ is inputted to the residual or remainder error storage SLS5 and there is determined in the correction time determining device 28 a correction time $\Delta t_i$, while taking into account the data $v_A$, $s_{ZR}$ and the time duration $\delta t$ of a period or cycle of the clock signal of the clock generator. For this purpose the peak velocity $v_A$ is recalled by the cycles or periods $\delta t$ of the clock signal so frequently until there has been obtained the residual target error $s_{ZR}$ (rectangle $v_A\cdot\Delta t_i$, FIG. 4). After the determination of the correction time $\Delta t_i=n\cdot\delta t=s_{ZR}:v_A$ the residual target error $s_{ZR}$ is infed to the last summation stage 20 of the reference value transmitter SWG which produces the parth s and there is produced by the correction time determining device 28 a second start signal, whereupon the reference value-clock generator of the control storage FWS again begins to work (point III, FIG. 4). After an interruption time of $\Delta t+\Delta t_{ti}$ the reference value transmitter SWG therefore produces, starting with the reference value cycle 9, the descending portion of the optimum travel curve E, which corresponds to the descending portion of the travel curve A (FIG. 4), and the produced path $s_{ref}$ in the target region exactly coincides with the path $s_x$ correlated to the ideal travel curve D.

Continuing, reference character EK designates an arrival correction device which is assigned the task, by correcting the path-reference value $s_{ref}$ during the travel-in or arriving phase, of maintaining as small as possible the halt error resulting from deviations between the storey site eo and the cabin site ko. This deviation can result for instance from the slip-associated writing-in of the storage site eo and from changes in the building or structure resulting from contraction and elongation. The arrival correction device EK consists of a switching device 29 arranged at the elevator cabin 5, for instance a magnetic switch, which coacts with tabs 31 or equivalent structure secured in the elevator shaft 30, an arriving or travel-in storage SLS6, an adder 32 and a subtractor 33. The arriving storage SLS6 is connected with the cabin path counter 14 of the second actual-value transmitter IWG2, the switching device 29 and the adder 32. The subtracter or subtracting unit 33 is operatively connected with the adder or adding unit 32, the storey site memory or storage SLS2 and the residual error storage SLS5 of the stop correction device STK. The arrival storage or memory SLS6 is a data buffer which is connected by means of the databus with the microprocessor, wherein the microprocessor performs the functions of the adder 32 and the subtracter 33.

The previously described arrival correction device EK operates in the following manner:

Shortly prior to arrival at a target storey or floor the magnetic switch 29 produces a pulse, with the result that the momentary cabin location or site ko is written into the arrival storage or memory SLS6 and delivered to the adder 32. In the adder 32 there is added to the momentary cabin site ko an amount kb corresponding to a constant arrival path. From the thus formed sum and the storey or floor site eo which has been recalled out of the storey site storage SLS2 and corresponding to the target storey site zo', there is produced in the subtracter or subtracting unit 33 a difference which is then infed to the residual error storage SLS5 and is recalled therefrom in the reference value transmitter SWG, for purposes of correction of the path-reference value $s_{ref}$.

A counter correction device ZK has the task of further improving the halt or stopping accuracy in that the cabin path counter 14 newly sets the second actual-value transmitter IWG2 and there is extinguished the storey site eo which has been stored in the storey site storage or memory SLS2 and correlated to the target storey of a subsequent travel and the storey site storage SLS2 is newly set in accordance with the corrected counter state. The counter correction device ZK consists of a subtracter 34 and an adder 35. The inputs of the subtracter 34 are connected with the output of the copier device 16 and the adder 32 of the arrival correction device EK. The inputs of the adder 35 are connected with the storey site storage SLS2 and the output of the subtracter 34. The output of the adder 35 is connected with an input of the cabin path counter 14. The functions of the subtracter 34 and the adder 35 are carried out by the microprocessor.

The previously described counter correction device functions as follows:

Upon arrival of the elevator cabin 5 at a main halt location enh, there is formed a difference representative of a halt or stop error in the subtracter 34 from the actual counter state recalled from the copier device 16 during standstill of the elevator cabin 5 and the counter state formed by means of the arrival storage or memory SLS6. This difference is inputted to the adder or adding device 35 where there is formed the new counter state while incorporating the storey site eo correlated to the main halt location enh. The new counter state is then infed to the cabin path counter 14, which is correspondingly newly set. After the subsequent travel the storey site eo of the target storey or floor is newly set in accordance with the corrected counter state by means of the arrival storage SLS6. The logic circuit needed for the determination of the main halt location enh and the triggering of the counter correction as well as the writing-in of the new storage site eo has not been particularly illustrated and described.

In order to further improve the optimum travel curve E it is also possible to undertake the correction computation upon arrival of the halt or stop initiation signal even before reaching the peak velocity $v_A$, and during each reference value cycle to feed part of the residual target error $s_{ZR}$ which has been stored in the residual error storage SLS5 into the summation stage 20 which produces the path reference value $s_{ref}$.

It is possible to produce as the output magnitude of the reference value transmitter SWG a cabin-reference site, so that for the purpose of forming the displacement path-regulation deviation $\Delta s$ the cabin-actual site which arises at the output of the copying device 16 can be directly infed to the subtracter or subtracting device 8. In this case there can be dispensed with the start site storage SLS1 and the subtracting device 17 of the actual-value transmitter IWG2.

Furthermore, is is possible to use for the actual-value transmitter IWG1 of the velocity regulation circuit a tachometer which generates the regulation magnitude in analogue form, whereby the D/A-converter is arranged at the output of the subtracting device 8 of the position regulation circuit. It is also possible to use the pulse transmitter 10 of the velocity regulation circuit simultaneously as the pulse transmitter for the position regulation circuit, so that there no longer is required the pulse transmitter 12 which is driven by the elevator cabin 5.

It is equally possible to compute the target path steps ($\Delta s_n$) stored in the target path stepping memory or storage SLS3, so that there can be dispensed with the target path stepping storage SLS3.

While there are shown and described present preferred embodiments of the invention, it is to be distinctly understood that the invention is not limited thereto, but may be otherwise variously embodied and practiced within the scope of the following claims. Accordingly,

What we claim is:

1. A drive control for a transportation system, especially an elevator having an elevator cabin, comprising:

a regulation circuit;

said regulation circuit comprising:

a velocity regulation circuit;

a position regulation circuit including an actual-value transmitter;

at least one pulse transmitter operatively associated with the actual-value transmitter of the position regulation circuit; and at least one digital-analogue converter;

a reference value transmitter generating a group of travel curves;

a control storage provided for said reference value transmitter;

said control storage containing at least permissible jerk values and threshold values of the acceleration of the elevator cabin;

three summation stages with which there is connected the control storage;

said summation stages generating by progressive numerical integration, respectively, the acceleration, the velocity and the displacement path of the elevator cabin;

said three summation stages including a last summation stage delivering an output magnitude to said regulation circuit as a displacement path-reference value;

a storey site storage;

a stop initiation device serving for the determination of a braking application point of the elevator cabin;

said stop initiation device coacting with said control storage and said storey site storage and generating a stop initiation signal;

a stop correction device with which there is connected said stop initiation device;

said stop correction device producing by interpolation of neighboring elevator travel curves an optimum travel curve and controlling the control storage of the reference-value transmitter;

an arrival correction device connected with the actual-value transmitter of the position regulation circuit and the storey site storage;

said arrival correction device influencing said reference-value transmitter;

a counter correction device acting upon said actual-value transmitter and said storey site storage; and a current regulation circuit operatively connected with said velocity regulation circuit.

2. The drive control as defined in claim 1, wherein:

said control storage of the reference-value transmitter comprises a programmable read-only memory which is adapted to be connected by means of a data bus with a microprocessor;

a reference value-clock generator capable of being controlled by a pulse stepdown device;

said read-only memory being operatively associated with said reference value-clock generator which is controlled by a clock generator of the microprocessor by means of the pulse stepdown device; and stored threshold values of jerk, acceleration and stored threshold values of velocity being associated with individual reference value cycles of the reference value-clock generator and upon occurrence thereof can be recalled from the control storage.

3. The drive control as defined in claim 1, wherein:

said storey site storage comprises a buffered, variable storage constituted by a random access memory;

a voltage source, independent of a power supply network, provided for said random access memory;

said random access memory storing storey sites corresponding to storey numbers;

said random access memory including a logic for incrementizing the storey numbers during upward elevator travel and for deincrementizing the storey numbers during downward travel of the elevator cabin.

4. The drive control as defined in claim 1, wherein:

the stop initiation device comprises a target path-stepping storage which stores differences ($\Delta s_n$) of the paths ($s_n$, $s_{n-1}$) of neighboring elevator travel curves;

said target path-stepping storage being constituted by a random access memory where there can be recalled differences between corresponding target path steps upon occurrence of reference value cycles (n);

said target path-stepping storage being capable of being connected by means of a data bus with a microprocessor which accumulates target path steps ($\Delta s_n$) into a target path ($s_n$); and said storey site storage determining the next closest situated target storey site and being connected by the data bus with the microprocessor which forms from the deviation between a target storey site (zo') and the sum (zo) of the start site and the target path ($z_n$) a target error ($s_{zn}$) as well as generating from the difference thereof and the target path step ($\Delta s_{n+1}$) of the next reference value cycle (n+1) a stop initiation signal when $s_{zn} \leqq \Delta s_{n+1}$.

5. The drive control as defined in claim 1, wherein:

said stop correction device contains a target error storage for storing a target error;

said target error storage comprising a random access memory;

said target error storage being capable of being connected by means of a data bus with a microprocessor which determines upon reaching a peak velocity the travel curve governed by a stop initiation signal by dividing the target error by the peak velocity so as to obtain a correction time;

a residual error storage comprising a random access memory;

said residual error storage storing a residual target error resulting from such division operation;

a part of the residual target error being recallable from the residual error storage for each reference value cycle; and values forming a delay portion of the travel curve being recallable from the control storage.

6. The drive control as defined in claim 1, wherein:

the pulse transmitter operatively associated with the actual-value transmitter of the position regulation circuit being drivably connected with the elevator cabin.

7. The drive control as defined in claim 1, further including:

a velocity limiter driven by the elevator cabin; and the pulse transmitter associated with the actual-value transmitter of the position regulation circuit being coupled with said velocity limiter.

8. The drive control as defined in claim 1, wherein:

said velocity regulation circuit has an actual-value transmitter;

said actual-value transmitter being provided with a second pulse transmitter driven by a drive machine driving the elevator cabin;

said velocity regulation circuit having a subtracting unit for forming a regulation deviation and containing an output side; and said digital-analogue converter being connected to said output side of said subtracting unit of the velocity regulation circuit.

9. The drive control as defined in claim 1, wherein:

a control magnitude of the velocity regulation circuit constitutes a displacement path regulation-deviation of the position regulation circuit.

10. The drive control as defined in claim 5, further including:

a cabin displacement path counter provided for said actual-value transmitter;

said arrival correction device comprises a switching device arranged at the elevator cabin;

an arrival storage in the form of a data buffer;

said switching device being connected with said arrival storage;

upon occurrence of a short pulse produced prior to arrival at a target storey said switching device writing into the arrival storage the momentary elevator cabin site determined in said cabin displacement path counter of the actual-value transmitter; and said arrival storage being capable of being connected by means of a data bus with a microprocessor which adds the momentary cabin site to a constant magnitude corresponding to an arrival path and from the thus formed sum and a target storey site generates a difference which can be written into the residual error storage.

11. The drive control as defined in claim 10, wherein:

said counter correction device comprises connecting means leading from the storey site storage by means of a microprocessor for adding the storey site of a primary stop location to a stop error and delivering such sum to the cabin path counter of the position regulation circuit actual-value transmitter; and a further connection means leading from the output of a data buffer connected with the cabin displacement path counter by means of the microprocessor to the output of the arrival storage and the storey site storage; and said microprocessor forming the stop error by subtraction of the counter state recalled out of the data buffer during elevator cabin standstill at the primary stop location and the counter state of the arrival storage plus a constant magnitude.

* * * * *